US010634384B2

(12) United States Patent
Ishikawa et al.

(10) Patent No.: US 10,634,384 B2
(45) Date of Patent: Apr. 28, 2020

(54) INDOOR UNIT OF AIR-CONDITIONING APPARATUS

(71) Applicant: Mitsubishi Electric Corporation, Tokyo (JP)

(72) Inventors: Masato Ishikawa, Tokyo (JP); Akimoto Suzuki, Tokyo (JP); Masahide Kinami, Tokyo (JP); Hisanori Ikeda, Tokyo (JP); Youhei Koyanagi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 236 days.

(21) Appl. No.: 15/569,416

(22) PCT Filed: Aug. 24, 2015

(86) PCT No.: PCT/JP2015/073704

§ 371 (c)(1),
(2) Date: Oct. 26, 2017

(87) PCT Pub. No.: WO2017/033258

PCT Pub. Date: Mar. 2, 2017

(65) Prior Publication Data

US 2018/0080679 A1 Mar. 22, 2018

(51) Int. Cl.

| | |
|---|---|
| ***F24F 13/20*** | (2006.01) |
| ***F24F 1/0057*** | (2019.01) |
| ***F24F 13/28*** | (2006.01) |

(52) U.S. Cl.

CPC ..... *F24F 13/20* (2013.01); *F24F 1/0057* (2019.02); *F24F 13/28* (2013.01)

(58) Field of Classification Search

CPC ..... F24F 1/0057; F24F 13/20; F24F 13/28; F24F 1/0007; F24F 1/0025; F24F 1/0011;

(Continued)

(56) References Cited

U.S. PATENT DOCUMENTS 5,547,272 A * 8/1996 Paterson ..... G06F 1/181 312/138.1
5,884,988 A * 3/1999 Foo ..... G06F 1/181 312/223.2

(Continued)

FOREIGN PATENT DOCUMENTS

EP 1 681 517 A1 7/2006
EP 1780474 * 5/2007

(Continued)

OTHER PUBLICATIONS

Office Action dated Jan. 8, 2019 issued in corresponding JP patent application No. 2017-536095 (and English translation).

(Continued)

*Primary Examiner* — Janet M Wilkens
(74) *Attorney, Agent, or Firm* — Posz Law Group, PLC

(57) ABSTRACT

An indoor unit of an air-conditioning apparatus includes: a front panel arranged on a front side of an indoor unit body and having a flat shaped front surface; and a design cover mounted on a front side of the front panel and including an upper design cover and a lower design cover formed separately from the upper design cover, the front panel including: a recess formed to be recessed from the front side to a back side in a center of the front panel in an up-and-down direction in front view, and extending from an inner side of a left end portion of the front panel to an inner side of a right end portion of the front panel; an air inlet formed below the recess; a left-hand recess side portion; and a right-hand recess side portion. The left-hand recess side portion is flat and flush with flat surfaces above and below the left-hand recess side portion, the right-hand recess side portion is flat and flush with flat surfaces above and below the right-hand recess side portion.

6 Claims, 5 Drawing Sheets

(58) Field of Classification Search
CPC ..... F24F 2221/26; A47L 15/4265; A47B 2096/207; A47B 2096/208; G06F 1/181
USPC ..... 312/265.5, 265.6, 236, 213, 204
See application file for complete search history.

(56) References Cited

U.S. PATENT DOCUMENTS

| | | | | |
|---|---|---|---|---|
| 8,540,557 | B1 * | 9/2013 | Derks | F24F 13/24 454/184 |
| 8,622,487 | B2 * | 1/2014 | Jung | D06F 39/12 312/204 |
| 9,523,511 | B2 * | 12/2016 | Ikeda | F24F 11/30 |
| 10,429,087 | B2 * | 10/2019 | Shishido | F24F 13/10 |
| 2003/0090182 | A1 * | 5/2003 | Johnson | G06F 1/181 312/265.5 |
| 2003/0091784 | A1 * | 5/2003 | Nykamp | A47B 96/206 428/99 |
| 2003/0145618 | A1 * | 8/2003 | Moon | F24F 1/0007 62/285 |
| 2005/0284168 | A1 * | 12/2005 | Lee | F24F 1/0007 62/317 |
| 2006/0185381 | A1 * | 8/2006 | Kim | F24F 1/0007 62/331 |
| 2007/0101744 | A1 * | 5/2007 | Yamashita | F24F 1/0007 62/298 |
| 2008/0047288 | A1 | 2/2008 | Nakamura | |
| 2008/0252186 | A1 * | 10/2008 | Crompton | F25D 23/10 312/204 |
| 2010/0141102 | A1 * | 6/2010 | Jung | A47L 15/4265 312/204 |
| 2010/0287973 | A1 * | 11/2010 | Son | F24F 1/0007 62/407 |
| 2012/0111045 | A1 | 5/2012 | Ikeda et al. | |
| 2015/0047815 | A1 | 2/2015 | Ikeda et al. | |
| 2017/0176026 | A1 * | 6/2017 | Lee | F24F 13/12 |
| 2018/0080679 | A1 * | 3/2018 | Ishikawa | F24F 13/20 |
| 2018/0135882 | A1 * | 5/2018 | Ikeda | F24F 13/20 |
| 2018/0283730 | A1 * | 10/2018 | Suzuki | F24F 13/20 |
| 2018/0328621 | A1 * | 11/2018 | Naito | F24F 13/20 |
| 2018/0363943 | A1 * | 12/2018 | Shirota | F24F 13/15 |
| 2018/0363944 | A1 * | 12/2018 | Moro | F24F 1/0025 |
| 2019/0056119 | A1 * | 2/2019 | Shishido | F24F 1/0057 |
| 2019/0113243 | A1 * | 4/2019 | Sato | F24F 1/0025 |

FOREIGN PATENT DOCUMENTS

| | | | | |
|---|---|---|---|---|
| EP | 1 953 461 | A1 | | 8/2008 |
| EP | 2 148 145 | A1 | | 1/2010 |
| JP | 2006-091602 | A | | 4/2006 |
| JP | 2006-145106 | A | | 6/2006 |
| JP | 2007-101029 | A | | 4/2007 |
| JP | 4849241 | B2 | | 10/2011 |
| JP | 2013-100939 | A | | 5/2013 |
| JP | 2013148237 | | * | 8/2013 |
| JP | 5406930 | B2 | | 2/2014 |
| JP | 2014-052183 | A | | 3/2014 |
| KR | 10-2008-0070378 | A | | 7/2008 |
| KR | 1020080096957 | A | | 11/2008 |
| WO | 2005022044 | | * | 3/2005 |
| WO | 2011090047 | | * | 7/2011 |
| WO | 2017033258 | | * | 3/2017 |
| WO | 2017094115 | | * | 6/2017 |
| WO | 2017138065 | | * | 8/2017 |
| WO | 2018167868 | | * | 9/2018 |
| WO | 2013108658 | | * | 10/2019 |

OTHER PUBLICATIONS

International Search Report of the International Searching Authority dated Nov. 24, 2015 for the corresponding international application No. PCT/JP2015/073704 (and English translation).
Extended European Search Report dated Jul. 5, 2017 in the corresponding European Patent application No. 15 888 726.5.
Office Action dated Jul. 17, 2019 issued in corresponding CN patent application No. 201580082534.6 (and English translation).
European Office action dated Nov. 15, 2019 issued in corresponding EP patent application No. 15888726.5.
Examination Report dated Jan. 22, 2020 issued in corresponding in patent application No. 201747040990.
Office Action dated Feb. 26, 2020 issued in corresponding CN patent application No. 201580082534.6 (and English translation).

* cited by examiner

INDOOR UNIT OF AIR-CONDITIONING APPARATUS

CROSS REFERENCE TO RELATED APPLICATION

This application is a U.S. national stage application of PCT/JP2015/073704 filed on Aug. 24, 2015, the contents of which are incorporated herein by reference.

TECHNICAL FIELD

The present invention relates to an indoor unit of an air-conditioning apparatus, and more particularly, to the structure of a front panel.

BACKGROUND ART

Recently, in an indoor unit of an air-conditioning apparatus, it has become a mainstream that the indoor unit employs a design having a flat surface shape without being provided with a bar in a front surface of a front panel so as to blend with an interior's design of a room, resulting in sucking the air through a top of the indoor unit. However, in this no front bar configuration, an amount of the air to be sucked from the top becomes insufficient, because the air cannot be sucked through the front. As a result, the air is required to be taken from the front panel, too. Then, there has been proposed an indoor unit of an air-conditioning apparatus (see, for example, Patent Literature 1) having such a configuration that a horizontal recess is formed in a vertical center of a front panel having a flat surface shape, and that a part of the horizontal recess is formed as an air inlet. With this configuration, the amount of the air to be sucked is increased, a monotonous design of the flat surface is accented, and designing ability is enhanced.

In this case, the front panel is required to be mountable/dismountable and easily handled so as to enable inspection and repair of the indoor unit of an air-conditioning apparatus, or cleaning of an internal filter and the front panel. Accordingly, in a case of the configuration in which the horizontal recess is formed in the vertical center of the front panel formed of a synthetic resin into the flat surface shape, and in which the part of the horizontal recess is formed as the air inlet, a region of the front panel extending from an edge of the air inlet to a right or left end portion is liable to deform and crack due to an external force generated, for example, when the front panel falls down at the time of mounting or dismounting the front panel. Accordingly, in Patent Literature 1, in order to reinforce strength, a bottom surface of the recess at the right or left end portion is shallower than a bottom surface of the recess at a portion excluding the right and left end portions.

CITATION LIST

Patent Literature

Patent Literature 1: Japanese Patent No. 4849241

SUMMARY OF INVENTION

Technical Problem

However, in Patent Literature 1, strength of the recess at the right or left end portion is lower than that of the recess at the portion excluding the right and left end portions. When the external force generated, for example, by the fall is applied to the front panel, there is still a problem in that the recess at the right or left end portion is most liable to deform and break.

The present invention has been made in order to solve the above-mentioned problem, and has an object to provide an indoor unit of an air-conditioning apparatus capable of preventing deformation and breakage, and enhancing designing ability.

Solution to Problem

According to one embodiment of the present invention, there is provided an indoor unit of an air-conditioning apparatus, including: a front panel arranged on a front side of an indoor unit body and having a flat shaped front surface; and a design cover mounted on a front side of the front panel, the front panel including: a recess formed in a center of the front panel in an up-and-down direction in front view, and extending from an inner side of a left end portion of the front panel to an inner side of a right end portion of the front panel; an air inlet formed below the recess; a left-hand recess side portion positioned on a left side of the recess of the front panel in front view; and a right-hand recess side portion positioned on a right side of the recess of the front panel in front view, the design cover including: an upper design cover configured to cover a region extending from an upper end portion of the recess to an upper end portion of the front panel and extending from a left end portion to a right end portion of the front panel in front view; and a lower design cover configured to cover a region extending from a lower end portion of the recess to a lower end portion of the front panel and extending from the left end portion to the right end portion of the front panel in front view, the left-hand recess side portion being flat and flush with flat surfaces above and below the left-hand recess side portion, the right-hand recess side portion being flat and flush with flat surfaces above and below the right-hand recess side portion.

Advantageous Effects of Invention

According to the indoor unit of an air-conditioning apparatus of one embodiment of the present invention, the left-hand recess side portion positioned on the left side of the recess of the front panel is flat and flush with the flat surfaces above and below the left-hand recess side portion, whereas the right-hand recess side portion positioned on the right side of the recess of the front panel is flat and flush with the flat surfaces above and below the right-hand recess side portion. Accordingly, deformation and breakage can be prevented as compared to a case where a portion corresponding to each recess side portion is formed into a recessed shape. Further, the region extending from the left end portion to the right end portion of the front panel is covered by the upper design cover and the lower design cover. With this configuration, a shadow is formed in a gap between the upper design cover and the lower design cover. Due to the shadow, a visual effect of dividing the front panel into upper and lower portions can be obtained. Accordingly, sharp and neat impressions can be produced, and designing ability can be enhanced.

DESCRIPTION OF EMBODIMENT

Figure 1:
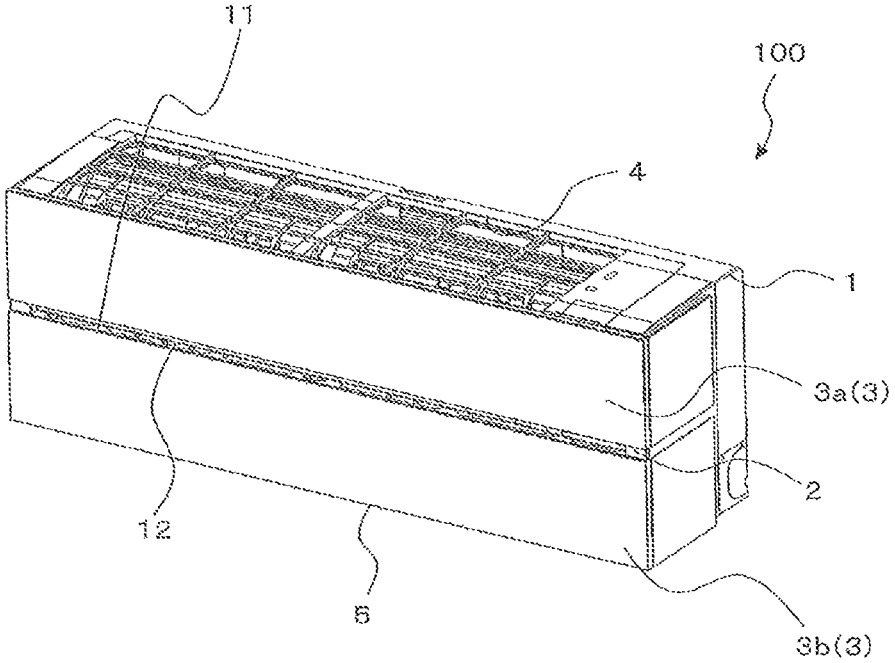
FIG. 1 is an external perspective view of an indoor unit of an air-conditioning apparatus according to an embodiment of the present invention when seen from a front side of the indoor unit.

Now, an embodiment of the present invention is described with reference to the drawings. Note that, the present invention is not limited to the embodiment described below. Further, in the drawings referred to below, the size relationship between components may be different from the actual ones in some cases.

EMBODIMENT

Figure 2:
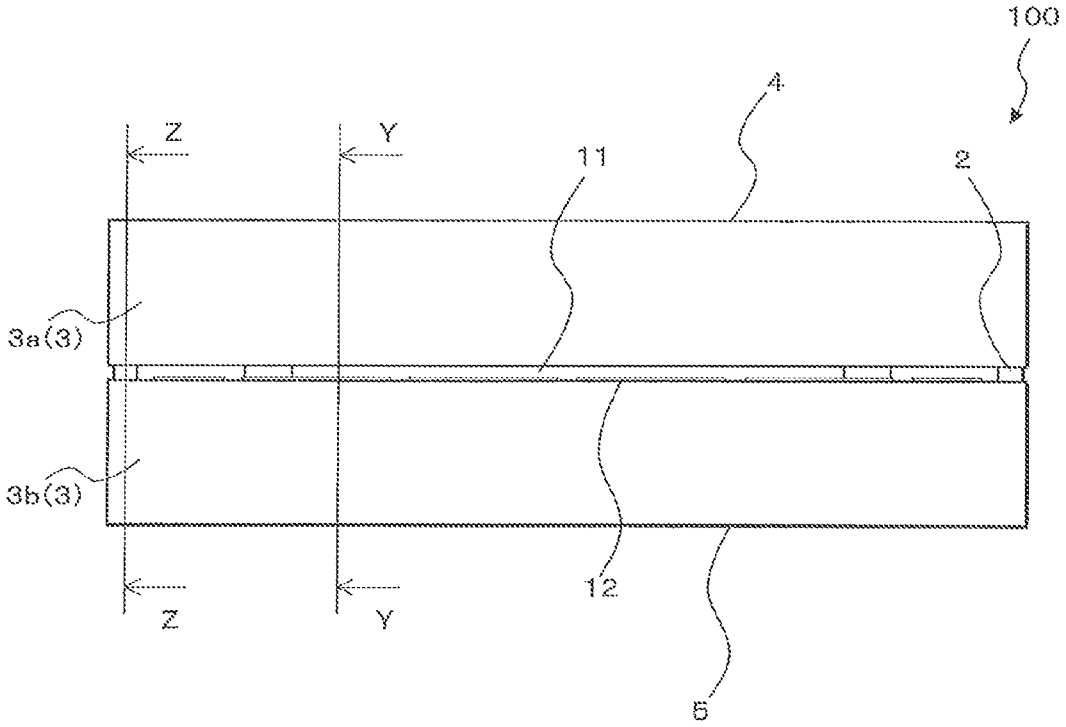
FIG. 2 is a front view of the indoor unit of an air-conditioning apparatus according to the embodiment of the present invention.
Figure 3:
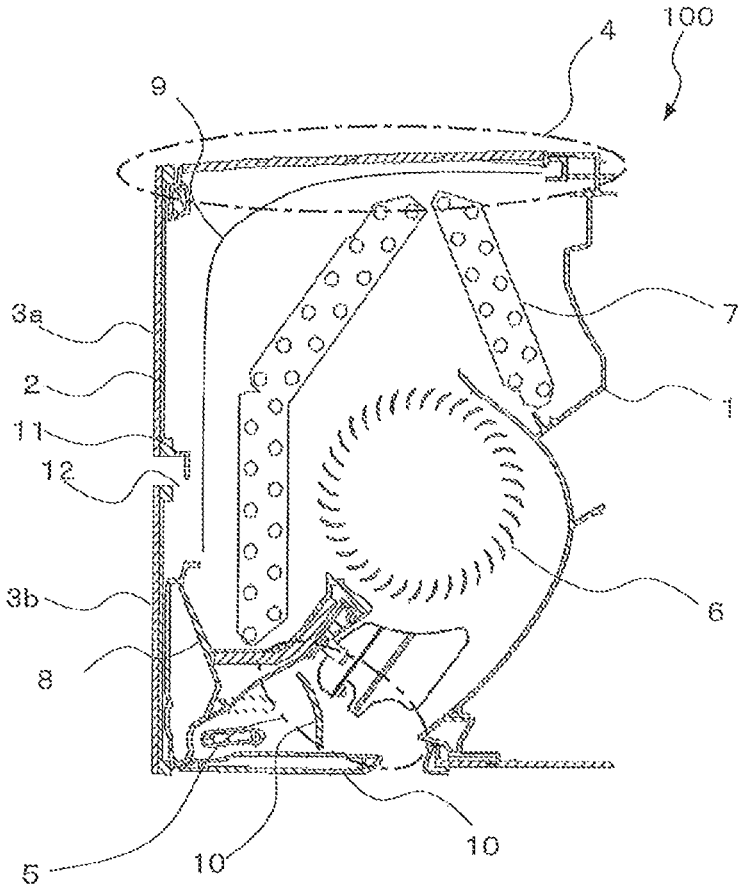
FIG. 3 is a sectional view of the indoor unit of an air-conditioning apparatus as seen from a direction of the arrows Y-Y of FIG. 2.
Figure 4:
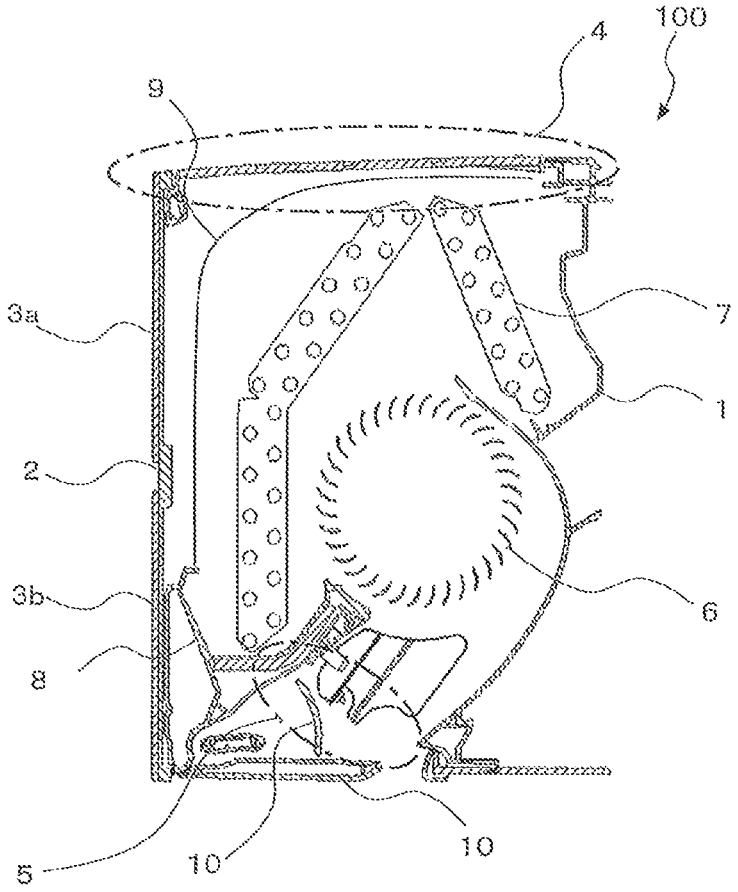
FIG. 4 is a sectional view of the indoor unit of an air-conditioning apparatus as seen from a direction of the arrows Z-Z of FIG. 2.

FIG. 1 is an external perspective view of an indoor unit of an air-conditioning apparatus according to an embodiment of the present invention when seen from a front side of the indoor unit. FIG. 2 is a front view of the indoor unit of an air-conditioning apparatus according to the embodiment of the present invention. FIG. 3 is a sectional view of the indoor unit of an air-conditioning apparatus as seen from a direction of the arrows Y-Y of FIG. 2. FIG. 4 is a sectional view of the indoor unit of an air-conditioning apparatus as seen from a direction of the arrows Z-Z of FIG. 2.

In the following description, for ease of understanding, directional terms (such as "upper", "lower", "right", and "left") are used as appropriate. The terms are used for the purpose of description, but do not limit the scope of the present invention. Further, in this embodiment, the terms "upper", "lower", "right", and "left" respectively correspond to upper, lower, right, and left sides of an indoor unit body 100 in front view.

Now, with reference to FIG. 1 to FIG. 4, a configuration of the indoor unit is described.

The indoor unit according to this embodiment supplies conditioned air into an air-conditioned space such as an inside of a room using a refrigeration cycle configured to circulate refrigerant. In this embodiment, there is exemplified a case in which the indoor unit is a wall-mounted type to be mounted to a wall surface of the air-conditioned space.

As illustrated in FIG. 1 and FIG. 2, the indoor unit body 100 includes a back case 1 arranged on a back side of the indoor unit body 100 and mounted to a wall surface, a front panel 2 arranged on a front side of the indoor unit body 100 and having a recess 11 and a front air inlet 12 formed therein, a design cover 3 mounted to a front side of the front panel 2, an upper air inlet 4 formed in an upper portion of the indoor unit body 100 and configured to mainly suck indoor air into the indoor unit body 100, and an air outlet 5 formed in a lower portion of the indoor unit body 100 and configured to supply the conditioned air into the air-conditioned space. The design cover 3 includes an upper design cover 3*a* and a lower design cover 3*b*.

As illustrated in FIG. 3 and FIG. 4, an air-sending fan 6 and a heat exchanger 7 are accommodated in the indoor unit body 100. The air-sending fan 6 sucks the indoor air through the upper air inlet 4 and the front air inlet 12, and blows out the conditioned air through the air outlet 5. The heat exchanger 7 is arranged so as to cover the air-sending fan 6 from above, and exchanges heat between the refrigerant and the indoor air, to thereby generate the conditioned air. Those components define an airflow path in the indoor unit body 100. Further, an electric component box (not shown) and a drain pan 8 are arranged in the indoor unit body 100. A circuit board and other components are accommodated in the electric component box. The drain pan 8 is arranged below a lower end portion of the heat exchanger 7, and is configured to collect water condensed on the heat exchanger 7.

The air-sending fan 6 is, for example, a cross flow fan, and the heat exchanger 7 is, for example, a fin-tube-type heat exchanger. However, the air-sending fan 6 and the heat exchanger 7 are not limited thereto.

Further, a filter 9 configured to remove dust and other matters contained in the sucked indoor air is arranged between the upper air inlet 4 and the heat exchanger 7 and between the front air inlet 12 and the heat exchanger 7. In addition, a vertical airflow direction adjusting flap 10 configured to control a direction of a flow of blown-out air is arranged in the air outlet 5.

Next, a flow of the air in the indoor unit body 100 is briefly described.

First, the air-sending fan 6 causes the indoor air to flow through the upper air inlet 4 and the front air inlet 12 of the indoor unit body 100 into the indoor unit body 100. At this time, dust and other matters contained in the air are removed by the filter 9. While passing through the heat exchanger 7, the indoor air is heated or cooled by the refrigerant circulating in the heat exchanger 7, and is changed into the conditioned air. Then, after a direction of a flow of the conditioned air is adjusted by the vertical airflow direction adjusting flap 10, the conditioned air is blown out through the air outlet 5 to an outside of the indoor unit body 100, that is, to the air-conditioned space.

Figure 5:
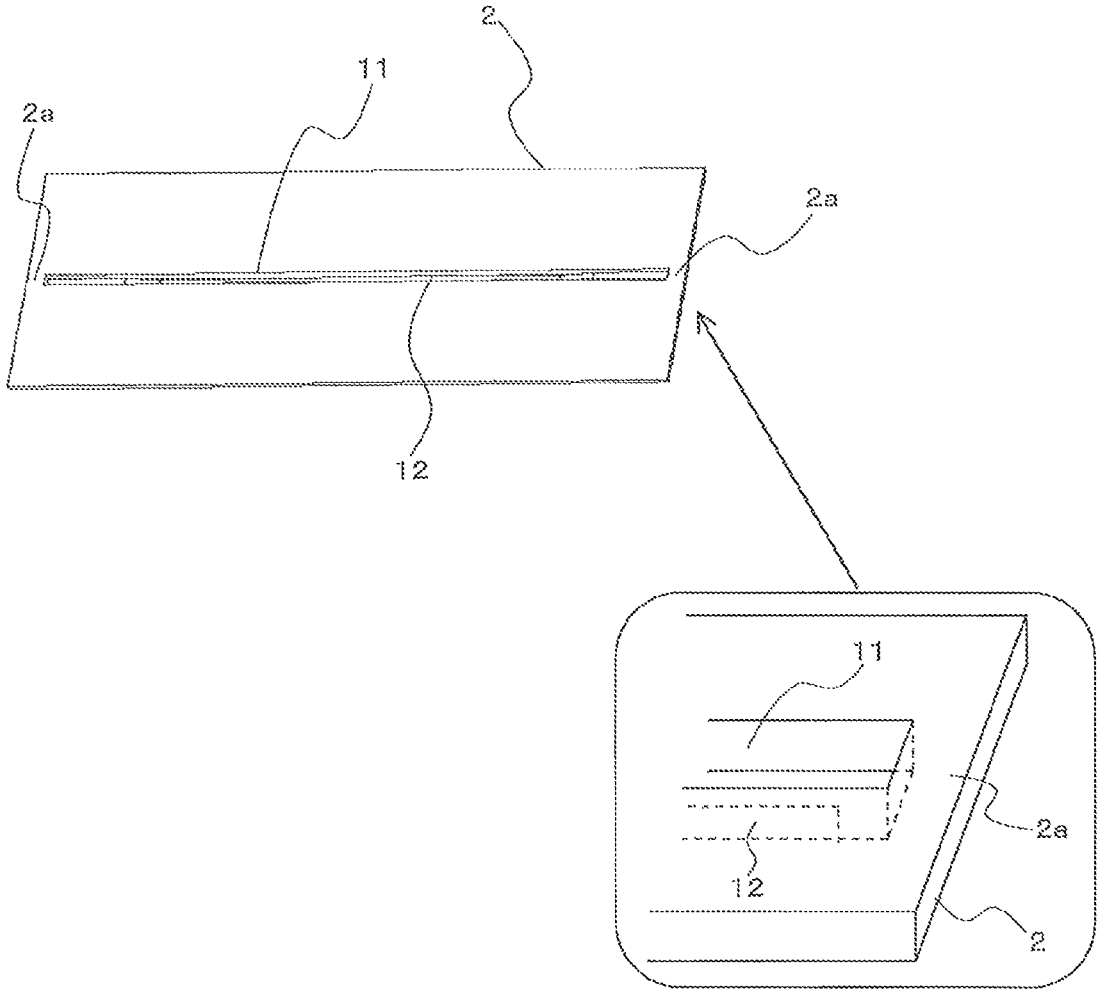
FIG. 5 is a perspective view of a front panel and an enlarged part of the front panel of the indoor unit of an air-conditioning apparatus according to the embodiment of the present invention.
Figure 6:
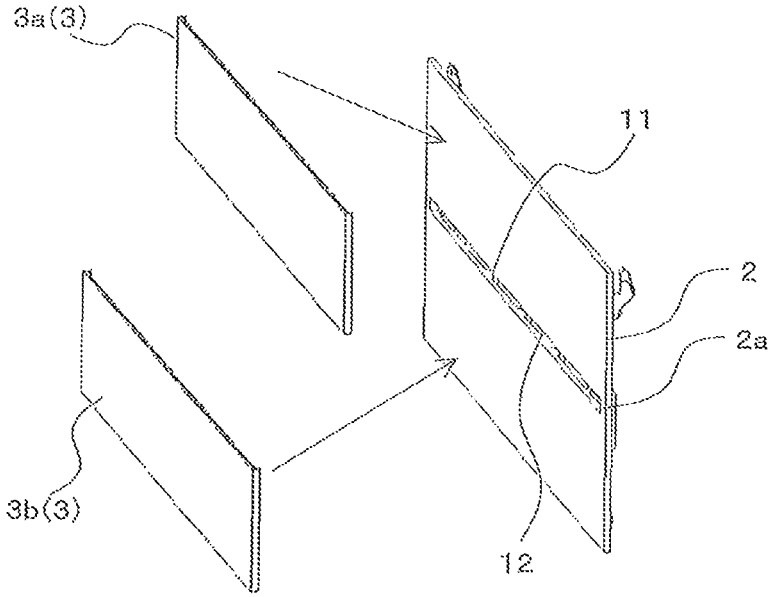
FIG. 6 is a perspective view of the front panel and a design cover of the indoor unit of an air-conditioning apparatus according to the embodiment of the present invention before the design cover is mounted to the front panel.
Figure 7:
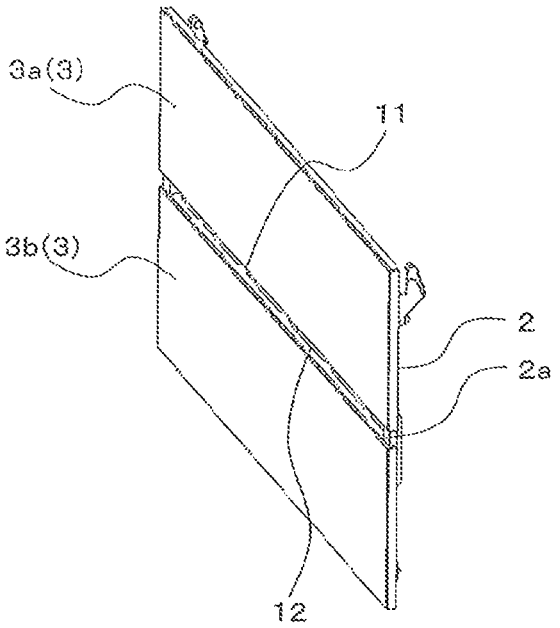
FIG. 7 is a perspective view of the front panel and the design cover of the indoor unit of an air-conditioning apparatus according to the embodiment of the present invention after the design cover is mounted to the front panel.

FIG. 5 is a perspective view of the front panel 2 and an enlarged part of the front panel 2 of the indoor unit of an air-conditioning apparatus according to the embodiment of the present invention. FIG. 6 is a perspective view of the front panel 2 and the design cover 3 of the indoor unit of an air-conditioning apparatus according to the embodiment of the present invention before the design cover 3 is mounted to the front panel 2. FIG. 7 is a perspective view of the front panel 2 and the design cover 3 of the indoor unit of an air-conditioning apparatus according to the embodiment of the present invention after the design cover 3 is mounted to the front panel 2. The arrow of FIG. 5 indicates the enlarged part of the front panel 2. Further, the arrows of FIG. 6 indicate positions to which the design cover 3 is to be mounted.

As illustrated in FIG. 5, in order to enhance designing ability, an entire front surface of the front panel 2 has a flat surface shape. Further, the front panel 2 has a rectangular shape. Under a state in which the indoor unit body 100 is mounted to the wall surface, a longitudinal direction of the front panel 2 corresponds to a lateral direction, that is, a horizontal direction, whereas a transverse direction of the front panel 2 corresponds to an up-and-down direction, that is, a vertical direction. Further, the recess 11 is formed in a center of the front panel 2 in the up-and-down direction in front view to extend from an inner side of a left end portion of the front panel 2 to an inner side of a right end portion thereof. Accordingly, as illustrated in FIG. 3, the center of the front panel 2 in the up-and-down direction is recessed from the front side to the back side.

However, as illustrated in FIG. 5, at the center of the front surface of the front panel 2 in the up-and-down direction, a portion on a left side of the recess 11, that is, a portion ranging from a left end portion of the recess 11 to the left end portion of the front panel 2 (hereinafter referred to as left-hand recess side portion 2*a*) is flat and flush with flat surfaces above and below the left-hand recess side portion 2*a*. In addition, at the center of the front surface of the front panel 2 in the up-and-down direction, a portion on a right side of the recess 11, that is, a portion ranging from a right end portion of the recess 11 to the right end portion of the front panel 2 (hereinafter referred to as right-hand recess side portion 2*a*) is flat and flush with flat surfaces above and below the right-hand recess side portion 2*a*. Further, the recess 11 is recessed from the front side to the back side, and the front air inlet 12 is formed below the recess 11.

Note that, a position at which the recess 11 is formed is not necessarily to be exactly the center of the front panel 2 in the up-and-down direction.

As illustrated in FIG. 6 and FIG. 7, the design cover 3 is formed of, for example, a transparent member, and an entire front surface of the design cover 3 has a flat surface shape similarly to that of the front panel 2. Further, the design cover 3 has a rectangular shape. Under the state in which the indoor unit body 100 is mounted to the wall surface, a longitudinal direction of the design cover 3 corresponds to the lateral direction, that is, the horizontal direction, whereas a transverse direction of the design cover 3 corresponds to the up-and-down direction, that is, the vertical direction. Further, a peripheral wall portion (not shown) protruding to the back side is formed on a part of or an entire region of four side portions of the design cover 3. The design cover 3 is mounted to the front panel 2 by a claw (not shown) formed on a part of or an entire region of the peripheral wall portion. Note that, a method of mounting the design cover 3 to the front panel 2 is not limited to the claw. The design cover 3 may be mounted to the front panel 2 with, for example, an adhesive.

Further, as illustrated in FIG. 6 and FIG. 7, the upper design cover 3*a* is mounted to an upper side of the recess 11 of the front panel 2 so as to cover a region extending from an upper end portion of the recess 11 to an upper end portion of the front panel 2 and extending from the left end portion to the right end portion of the front panel 2. Further, the lower design cover 3*b* is mounted to a lower side of the recess 11 of the front panel 2 so as to cover a region extending from a lower end portion of the recess 11 to a lower end portion of the front panel 2 and extending from the left end portion to the right end portion of the front panel 2. The design cover 3 is mounted to the front side of the front panel 2 in this manner, thereby enhancing designing ability of the indoor unit body 100 in front view.

Under a state in which the design cover 3 is mounted to the front side of the front panel 2, as illustrated in FIG. 3 and FIG. 4, the design cover 3 protrudes to the front side from the recess 11 and the right-hand and left-hand recess side portions 2*a* of the front panel 2. Accordingly, a shadow is formed in a gap between the upper design cover 3*a* and the lower design cover 3*b*. Further, the shadow is formed to extend from the left end portion to the right end portion of the front panel 2. Thus, even when the recess 11 is neither formed nor extended from the left end portion to the right end portion of the front panel 2, due to the shadow, a visual effect of dividing the front panel 2 into upper and lower portions can be obtained. Accordingly, sharp and neat impressions can be produced, and designing ability can be enhanced.

Further, the design cover 3 has such a size as to protrude from the right and left end portions of the front panel 2 when the design cover 3 is mounted to the front panel 2. When each side surface of the indoor unit body 100 is also formed so as to be divided into upper and lower portions, the side surface of the indoor unit body 100 can be designed to have uniformity with the front side thereof.

Note that, a color of the front panel 2 and a color of the design cover 3 may be the same color, such as a white color. When the color of the front panel 2 and the color of the design cover 3 are different from each other, for example, when the color of the front panel 2 is black and the color of the design cover 3 is red, the color of the recess 11 of the front panel 2 can be emphasized. Thus, designing ability can be further enhanced.

Further, the recess 11 of the front panel 2 is neither formed nor extended from the left end portion to the right end portion of the front panel 2. The left-hand recess side portion 2*a* is flat and flush with the flat surfaces above and below the left-hand recess side portion 2*a*. In addition, the right-hand recess side portion 2*a* is flat and flush with the flat surfaces above and below the right-hand recess side portion 2*a*. Accordingly, strength can be secured, and deformation and breakage can be prevented as compared to a case in which a portion corresponding to each recess side portion 2*a* is formed into a recessed shape.

Further, the upper design cover 3*a* and the lower design cover 3*b* are formed to be identical to each other. Thus, a cost required for a die for forming components, and a cost required for component management can be reduced, thereby being capable of reducing a manufacturing cost.

Further, the design cover 3 is formed of the transparent member. Thus, light is easily reflected, thereby being capable of enhancing designing ability.

Further, from the back side of the design cover 3, a coating is applied on the design cover 3 formed of the transparent member. Thus, the coated surface can be prevented from being damaged or peeling off. In addition, it is possible to hide a mounted form and dust caught between the design cover 3 and the front panel 2 when the design cover 3 is mounted to the front panel 2, thereby being capable of enhancing designing ability.

In this embodiment, the design cover 3 includes one upper design cover 3*a* and one lower design cover 3*b*, but the present invention is not limited thereto. The upper design cover 3*a* may be divided into a plurality of portions, for example, two portions. Similarly, the lower design cover 3*b* may also be divided into a plurality of portions, for example, two portions.

As described above, according to the indoor unit of an air-conditioning apparatus of this embodiment, the left-hand recess side portion 2*a* of the front panel 2 is flat and flush with the flat surfaces above and below the left-hand recess side portion 2*a*. In addition, the right-hand recess side portion 2*a* of the front panel 2 is flat and flush with the flat surfaces above and below the right-hand recess side portion 2*a*. Accordingly, deformation and breakage can be prevented as compared to the case in which the portion corresponding to each recess side portion 2*a* is formed into a recessed shape. Further, the upper design cover 3*a* covers the upper side of the recess 11 of the front panel 2 over the region extending from the upper end portion of the recess 11 to the upper end portion of the front panel 2 and extending from the left end portion to the right end portion of the front panel 2, whereas the lower design cover 3*b* covers the lower side of the recess 11 of the front panel 2 over the region extending from the lower end portion of the recess 11 to the lower end portion of the front panel 2 and extending from the left end portion to the right end portion of the front panel 2. With this configuration, the shadow is formed in the gap between the upper design cover 3*a* and the lower design cover 3*b*. Due to the shadow, the visual effect of dividing the front panel 2 into upper and lower portions can be obtained. Accordingly, sharp and neat impressions can be produced, and designing ability can be enhanced.

REFERENCE SIGNS LIST

1 back case 2 front panel 2*a* recess side portion 3 design cover 3*a* upper design cover 3*b* lower design cover 4 upper air inlet 5 air outlet 6 air-sending fan 7 heat exchanger 8 drain pan 9 filter 10 vertical airflow direction adjusting flap 11 recess 12 front air inlet 100 indoor unit body

The invention claimed is:

1. An indoor unit of an air-conditioning apparatus, comprising:

a front panel arranged on a front side of an indoor unit body and having a flat shaped front surface, the front panel defined by a front side and a back side opposite thereto, the front side of the front panel having a right end portion and a left end portion opposite to the right end portion; and a design cover mounted on the front side of the front panel, the front panel including:

a recess in a center of the front panel in an up-and-down direction in a front view, recessed from the front side of the front panel toward the back side of the front panel, and extending from a right side of the left end portion of the front panel to a left side of the right end portion of the front panel, in a sectional view the recess includes a top wall, a bottom wall, and a back wall substantially square to each other, the recess being defined by an upper end portion and a lower end portion opposite thereto;

an air inlet formed in a lower part of the recess;

a left-hand recess side portion positioned to a left side of the recess of the front panel in front view; and a right-hand recess side portion positioned to a right side of the recess of the front panel in front view, the design cover including:

an upper design cover configured to cover a region extending from the upper end portion of the recess to an upper end portion of the front panel and extending from the left end portion to the right end portion of the front panel in front view; and a lower design cover separated by the recess from the upper design cover and configured to cover a region extending from the lower end portion of the recess to a lower end portion of the front panel and extending from the left end portion to the right end portion of the front panel in front view, the left-hand recess side portion being flat and flush with flat surfaces above and below the left-hand recess side portion, the right-hand recess side portion being flat and flush with flat surfaces above and below the right-hand recess side portion.

2. The indoor unit of an air-conditioning apparatus of claim 1, wherein the design cover protrudes from the right and left end portions of the front panel in front view.

3. The indoor unit of an air-conditioning apparatus of claim 1, wherein the upper design cover and the lower design cover are formed to be identical to each other.

4. The indoor unit of an air-conditioning apparatus of claim 1, wherein an entire front surface of the front panel and an entire front surface of the design cover are flat.

5. The indoor unit of an air-conditioning apparatus of claim 1, wherein the design cover comprises a transparent member.

6. The indoor unit of an air-conditioning apparatus of claim 5, wherein the design cover is provided with a coating from a back side of the design cover.

* * * * *